US005797362A

United States Patent [19]

Taller

[11] Patent Number: 5,797,362

[45] Date of Patent: Aug. 25, 1998

[54] COMBUSTION ENGINE WITH ADJUSTABLE CAM AND LUBRICATION MEANS

[76] Inventor: Myron S. Taller, 1270 N. Ave. M2, New Rochelle, N.Y. 10804

[21] Appl. No.: 823,338

[22] Filed: Mar. 24, 1997

[51] Int. Cl.[6] ..... F01L 1/34; F01M 9/10

[52] U.S. Cl. ..... 123/90.17; 123/90.34; 123/90.6; 123/196 R; 123/196 M; 74/568 R; 184/6.5; 184/11.1; 184/13.1

[58] Field of Search ..... 123/90.15, 90.17, 123/90.18, 90.31, 90.34, 90.6, 196 R, 196 M; 74/567, 568 R; 184/6.5, 11.1, 13.1

[56] References Cited

U.S. PATENT DOCUMENTS

| | | | |
|---|---|---|---|
| 3,107,130 | 10/1963 | Lakey et al. | 184/11.1 |
| 3,499,503 | 3/1970 | Murray et al. | 184/11.1 |
| 3,958,541 | 5/1976 | Lachnit | 123/90.34 |
| 4,072,448 | 2/1978 | Loyd, Jr. | 123/90.6 |
| 4,388,897 | 6/1983 | Rosa | 123/90.17 |
| 4,570,581 | 2/1986 | Titolo | 123/90.17 |
| 4,711,203 | 12/1987 | Seidl | 123/90.6 |
| 4,870,872 | 10/1989 | Parsons | 123/90.17 |
| 4,991,549 | 2/1991 | Sugiura | 123/90.34 |
| 5,158,049 | 10/1992 | Neumann | 123/90.6 |
| 5,359,970 | 11/1994 | Krebs | 123/90.6 |

FOREIGN PATENT DOCUMENTS

| | | | |
|---|---|---|---|
| 2-11811 | 1/1990 | Japan | 123/90.17 |

*Primary Examiner*—Weilun Lo

[57] ABSTRACT

A combustion engine with adjustable cam and lubrication mechanism including a cam shaft with a plurality of threads formed therein. At least one cam has a threaded bore formed therein for allowing the cam to be adjustably coupled with the threads of the cam shaft. Further included is a lubrication mechanism attached to the cam shaft for agitating oil within the engine.

4 Claims, 3 Drawing Sheets

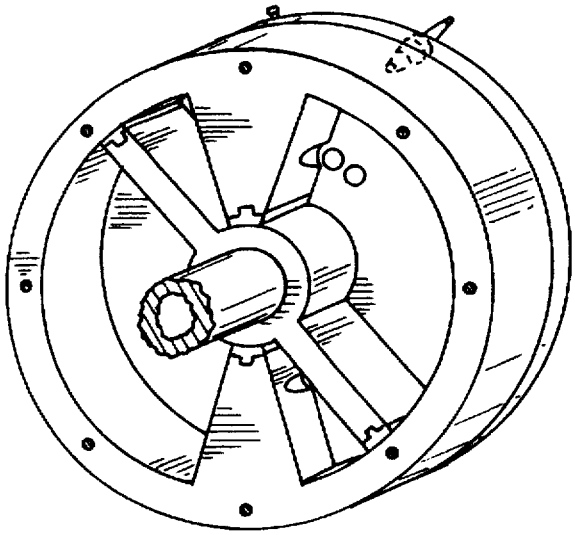
FIG 1
PRIOR ART
FIG 2
PRIOR ART
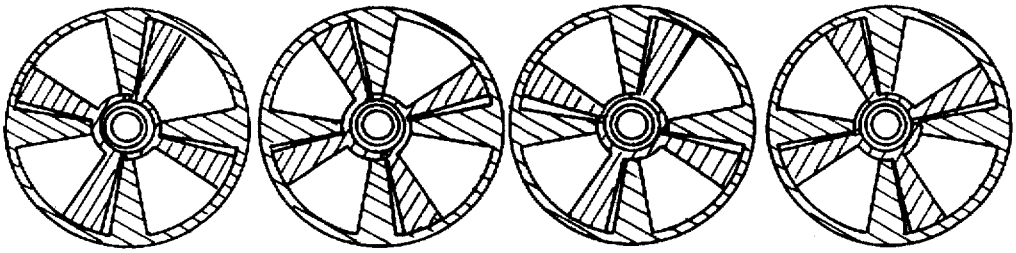

COMBUSTION ENGINE WITH ADJUSTABLE CAM AND LUBRICATION MEANS

BACKGROUND OF THE INVENTION

1. Field of the Invention

The present invention relates to a combustion engine with adjustable cam and lubrication means and more particularly pertains to providing a well lubricated combustion engine with timing adjustment capabilities.

2. Description of the Prior Art

The use of combustion engines is known in the prior art. More specifically, combustion engines heretofore devised and utilized for the purpose of powering various devices are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,640,242 to Meyman; U.S. Pat. No. 3,990,409 to Beverly; U.S. Pat. No. 4,664,078 to Bender; U.S. Pat. No. 4,428,339 to Fromer; U.S. Pat. No. 3,798,897 to Nutku; and U.S. Pat. No. 3,595,014 to McMaster.

In this respect, the combustion engine with adjustable cam and lubrication means according to the present invention substantially departs from the conventional concepts and designs of the prior art, and in so doing provides an apparatus primarily developed for the purpose of providing a well lubricated combustion engine with timing adjustment capabilities.

Therefore, it can be appreciated that there exists a continuing need for a new and improved combustion engine with adjustable cam and lubrication means which can be used for providing a well lubricated combustion engine with timing adjustment capabilities. In this regard, the present invention substantially fulfills this need.

SUMMARY OF THE INVENTION

In view of the foregoing disadvantages inherent in the known types of combustion engines now present in the prior art, the present invention provides an improved combustion engine with adjustable cam and lubrication means. As such, the general purpose of the present invention, which will be described subsequently in greater detail, is to provide a new and improved combustion engine with adjustable cam and lubrication means which has all the advantages of the prior art and none of the disadvantages.

To attain this, the present invention essentially comprises a cam shaft with a plurality of threads formed therein. The threads are serpentinely configured along an entire length of the cam shaft. Also included is a plurality of cams each with a generally oval configuration with a threaded bore formed in a first end thereof. The threaded bore of each cam is adapted to be threadedly coupled with the threads of the cam shaft. Note FIGS. 4 & 4A. By this structure, the cams may be adjusted along the cam shaft thereby adjusting the timing in which the cams abut associated cam followers. Such cam followers are not illustrated for purposes of clarity. For maintaining the cams in a desired location after being adjusted, a plurality of adjustable cam securement mechanisms are included. Each of such adjustable cam securement mechanisms are of a ring-shaped configuration. Further, each cam securement mechanism has an outer circumference and an inner circumference. The inner circumference is equipped with a plurality of threaded grooves formed therein. As shown in FIGS. 3 & 4A, a slot is formed between the inner circumference and the outer circumference defining two free ends. The free ends are spaced for allowing the inner circumference to be adjusted. As shown in FIG. 4, each adjustable cam securement mechanism further has a pair of axially aligned threaded apertures formed in the free ends thereof. As such, an adjustment bolt may be screwably engaged within the threaded apertures of an associated adjustable cam securement mechanism for allowing a user to manually adjust the inner circumference thereof. Further, the threaded grooves of the inner circumference of the adjustable cam securement mechanisms are screwably engaged with the threads of the cam shaft on opposite sides of each cam. In use, the adjustment bolts each have a first tightened orientation for precluding the adjustability of the associated cam and a second loosened orientation for allowing the adjustability of the associated cam. To ensure that the cam shaft and cams are properly lubricated, at least one oil agitator is provided. See FIG. 5. Each oil agitator includes a central portion having a cylindrical configuration and a threaded bore axially formed therein. A pair of fins are integrally coupled to an outer surface of the central portion of each agitator. Such fins extend radially outward therefrom and have a triangular configuration. Further provided as a component of the oil agitator is a threaded aperture formed in the central portion thereof between the outer surface and threaded bore. This threaded aperture is adapted for allowing a set bolt to be screwably inserted therein. As such, the threaded bore of each oil agitator is adapted to be threadedly engaged with the threads of the cam shaft for allowing the adjustability thereof and further securement in place by means of the set bolt. To accomplish this, the adjustment bolt of each oil agitator each has a first tightened orientation for precluding the adjustability of the associated oil agitator and a second loosened orientation for allowing the adjustability of the associated oil agitator.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved combustion engine with adjustable cam and lubrication means which has all the advantages of the prior art combustion engines and none of the disadvantages.

It is another object of the present invention to provide a new and improved combustion engine with adjustable cam and lubrication means which may be easily and efficiently manufactured and marketed.

It is a further object of the present invention to provide a new and improved combustion engine with adjustable cam and lubrication means which is of a durable and reliable construction.

An even further object of the present invention is to provide a new and improved combustion engine with adjustable cam and lubrication means which is susceptible of a low cost of manufacture with regard to both materials and labor, and which accordingly is then susceptible of low prices of sale to the consuming public, thereby making such combustion engine with adjustable cam and lubrication means economically available to the buying public.

Still yet another object of the present invention is to provide a new and improved combustion engine with adjustable cam and lubrication means which provides in the apparatuses and methods of the prior art some of the advantages thereof, while simultaneously overcoming some of the disadvantages normally associated therewith.

Still another object of the present invention is to provide a well lubricated combustion engine with timing adjustment capabilities.

Lastly, it is an object of the present invention to provide a new and improved combustion engine with adjustable cam and lubrication mechanism including a cam shaft with a plurality of threads formed therein. At least one cam has a threaded bore formed therein for allowing the cam to be adjustably coupled with the threads of the cam shaft. Further included is a lubrication mechanism attached to the cam shaft for agitating oil within the engine.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a prior art combustion engine with a conventional cam shaft as taught in U.S. Pat. No. 4,664,078.

FIG. 2 is a cross-sectional view of a prior art combustion engine depicting the various cam followers in different orientations as taught in U.S. Pat. No. 3,798,897.

Similar reference characters refer to similar parts throughout the several views of the drawings.

DESCRIPTION OF THE PREFERRED EMBODIMENT

Figure 3:
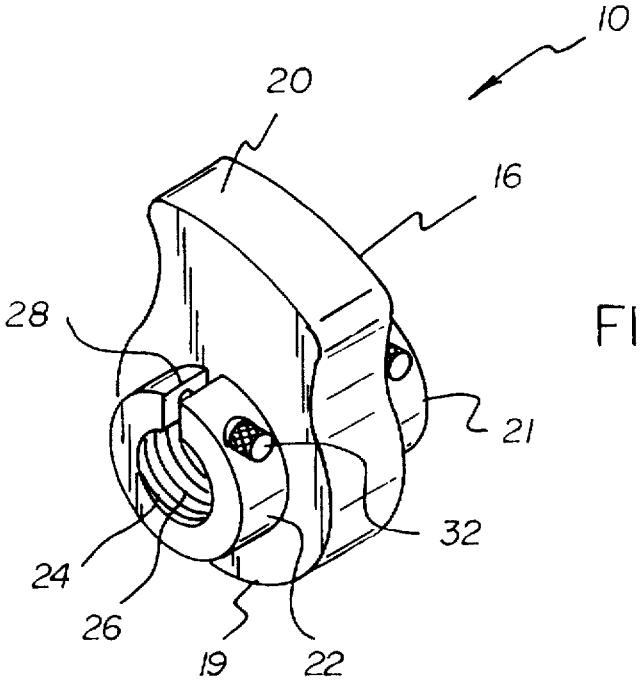
FIG. 3 is a perspective view of the cam and adjustable cam securement mechanisms of the present invention.

With reference now to the drawings, and in particular to FIG. 1 thereof, a new and improved combustion engine with adjustable cam and lubrication means embodying the principles and concepts of the present invention and generally designated by the reference numeral 10 will be described.

The present invention, the new and improved combustion engine with adjustable cam and lubrication means, is comprised of a plurality of components. Such components in their broadest context include a cam shaft, a plurality of cams, a plurality of adjustable cam securement mechanisms, and an oil agitator. Such components are individually configured and correlated with respect to each other so as to attain the desired objective.

More specifically, it will be noted that the system 10 of the present invention includes a cam shaft 12 with a plurality of threads 14 formed therein. Such cam shaft is connected to the transmission of the engine as is conventional in the art. The threads are serpentinely configured along an entire length of the cam shaft. Preferably, such threads are very fine, i.e. spaced less than 1 mm apart, for reasons that will become apparent later.

Also included is a plurality of cams 16 each with a generally oval configuration having a threaded bore 18 formed in a first end 19 thereof. The threaded bore of each cam is adapted to be threadedly coupled with the threads of the cam shaft. Note FIGS. 4 & 4A. By this structure, the cams may be adjusted along the cam shaft thereby adjusting the timing in which the cams abut associated cam followers. Such cam followers are not illustrated for purposes of clarity. To facilitate cooperation with the cam followers, each cam has a second end 20 which is equipped with a smooth curved surface, as is conventional in the art.

Figure 4:
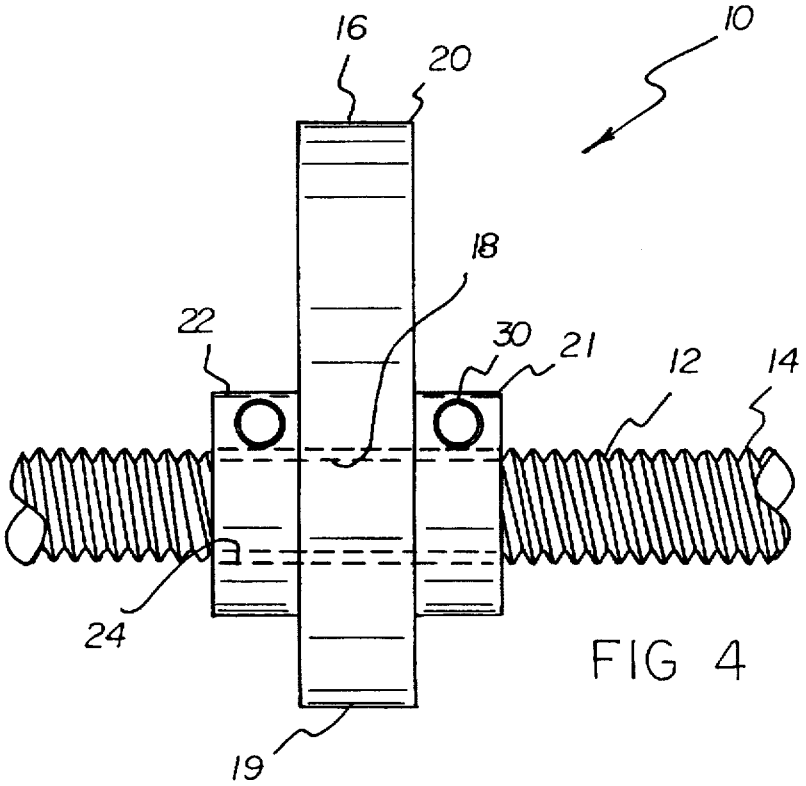
FIG. 4 is a side elevational view of the cam and adjustable cam securement mechanisms in their operative orientation.
Figure 4A:
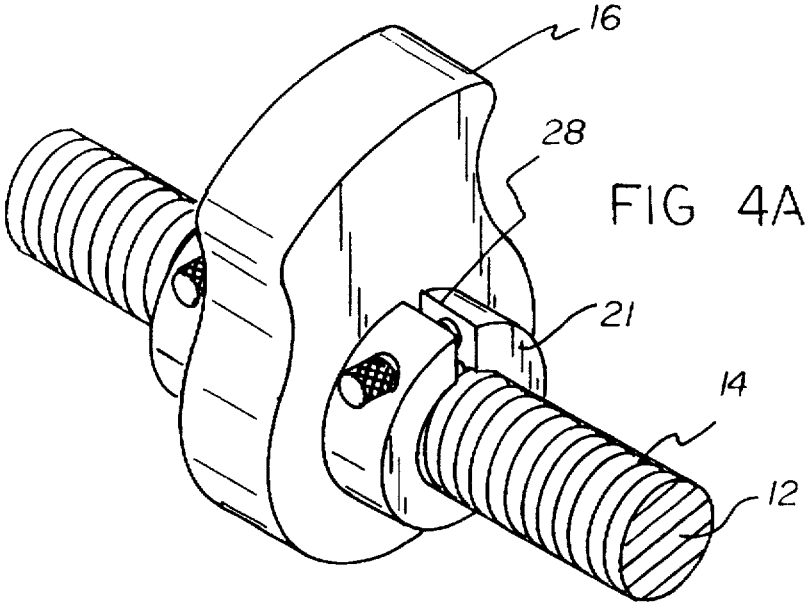
FIG. 4A is a perspective view of the cam and adjustable cam securement mechanisms in their operative orientation.

For maintaining the cams in a desired location after being adjusted, a plurality of adjustable cam securement mechanisms 21 are included. Each of such adjustable cam securement mechanisms are of a ring-shaped configuration. Further, each cam securement mechanism has an outer circumference 22 and an inner circumference 24. The inner circumference is equipped with a plurality of threaded grooves 26 formed therein. As shown in FIGS. 3 & 4A, a slot 28 is formed between the inner circumference and the outer circumference defining two free ends. The free ends are spaced for allowing the inner circumference to be adjusted. As shown in FIG. 4, each adjustable cam securement mechanism further has a pair of axially aligned threaded apertures 30 formed in the free ends thereof. As such, an adjustment bolt 32 may be screwably engaged within the threaded apertures of an associated adjustable cam securement mechanism for allowing a user to manually adjust the inner circumference thereof. Manual adjustment is facilitated by the inclusion of a knurled knob integrally formed at at least one end of each bolt. Further, the threaded grooves of the inner circumference of the adjustable cam securement mechanisms are screwably engaged with the threads of the cam shaft on opposite sides of each cam. It is critical that the cam securement mechanisms abut the associated cam. Ideally, the threaded grooves of the cam and adjustable cam securement mechanisms are fine similar to the cam shaft to permit the fine adjustment thereof. In use, the adjustment bolts each have a first tightened orientation for precluding the adjustability of the associated cam. Such is accomplished by the immense friction force which is afforded upon the reduction of the inner circumferences of the associated adjustable cam securement mechanisms. Each adjustable cam securement mechanism further has a second loosened orientation with the magnitude of the inner circumference of the adjustable cam securement mechanism suitable for allowing the adjustability of the cam securement mechanism and associated cam.

Figure 5:
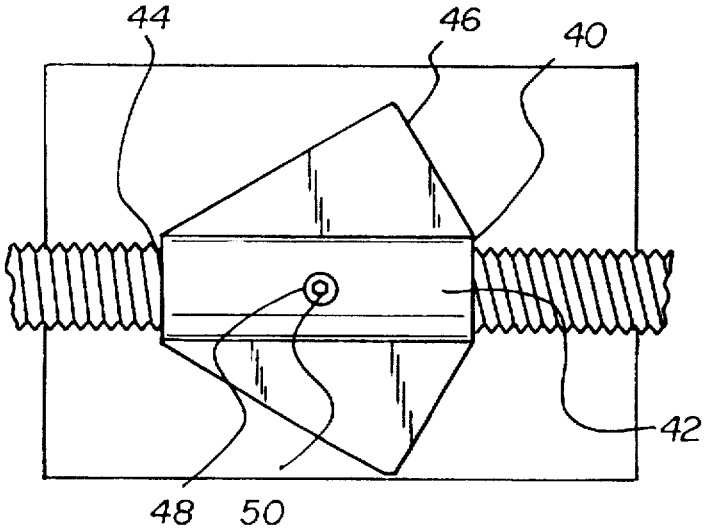
FIG. 5 is a side view of the oil agitator of the present invention in its operative orientation.

To ensure that the cam shaft and cams are properly lubricated, at least one oil agitator 40 is provided. See FIG. 5. Each oil agitator includes a central portion 42 having a cylindrical configuration and a threaded bore 44 axially formed therein. A pair of fins 46 are integrally coupled to an outer surface of the central portion of each agitator. Such fins extend radially outward therefrom and have a triangular configuration. Further provided as a component of the oil agitator is a threaded aperture 48 formed in the central portion thereof between the outer surface and threaded bore. This threaded aperture is adapted for allowing a set bolt 50 to be screwably inserted therein with an allen key. As such, the threaded bore of each oil agitator is adapted to be selectively engaged with the threads of the cam shaft for both allowing the adjustability thereof and further ensuring that the agitator is maintained in place by means of the set bolt. To accomplish this, the adjustment bolt of each oil agitator each has a first tightened orientation for precluding the adjustability of the associated oil agitator and a second loosened orientation for allowing the adjustability of the associated oil agitator. Ideally, an oil agitator is situated between each cam for affording optimal lubrication.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the united states is as follows:

1. A new and improved combustion engine with adjustable cam and lubrication means comprising, in combination:

a cam shaft with a plurality of threads formed therein, the threads being serpentinely configured along an entire length of the cam shaft;

a plurality of cams each with a generally oval configuration with a threaded bore formed in a first end thereof, the threaded bore of each cam adapted to be threadedly coupled with the threads of the cam shaft, whereby the cams may be adjusted along the cam shaft thereby adjusting the timing in which the cams abut associated cam followers;

a plurality of adjustable cam securement mechanisms each being ring-shaped and having an outer circumference, an inner circumference with a plurality of threaded grooves formed therein, and a slot formed between the inner circumference and the outer circumference defining two free ends for allowing the inner circumference to be adjusted, each adjustable cam securement mechanism further having a pair of axially aligned threaded apertures formed in the free ends and an adjustment bolt for allowing a user to manually adjust the inner circumference of each adjustable cam securement mechanism, wherein the threaded grooves of the inner circumference of the adjustable cam securement mechanisms are screwably engaged with the threads of the cam shaft on opposite sides of each cam with the set bolt each having a first tightened orientation for precluding the adjustability of the associated cam and a second loosened orientation for allowing the adjustability of the associated cam; and at least one oil agitator with a central portion having a cylindrical configuration, the central portion having a threaded bore axially formed therein with a pair of fins integrally coupled to an outer surface thereof and extended radially outward therefrom, each fin having a triangular configuration, the oil agitator further having a threaded aperture formed in the central portion thereof between the outer surface and threaded bore for allowing a set bolt to be screwably inserted therein, the threaded bore of each oil agitator adapted to be threadedly engaged with the threads of the cam shaft for allowing the adjustability thereof, the adjustment bolt of each oil agitator each having a first tightened orientation for precluding the adjustability of the associated oil agitator and a second loosened orientation for allowing the adjustability of the associated oil agitator.

2. A combustion engine with adjustable cam comprising:

a cam shaft;

at least one cam having an adjustable cam securement means for allowing the cams to be adjusted along the cam shaft thereby adjusting the timing in which the cams abut associated cam followers;

wherein the adjustable cam securement means includes a plurality of threads formed in the cam shaft with the threads being serpentinely configured along the cam shaft and further a threaded bore formed in a first end of each cam, the threaded bore of each cam adapted to be threadedly coupled with the threads of the cam shaft; and wherein the adjustable cam securement means further includes a plurality of cam securement mechanisms each being ring-shaped and having an outer circumference, an inner circumference with a plurality of threaded grooves formed therein, and a slot formed between the inner circumference and the outer circumference defining two free ends for allowing the inner circumference to be adjusted, each adjustable cam securement mechanism further having a pair of axially aligned threaded apertures formed in the free ends and an adjustment bolt for allowing a user to manually adjust the inner circumference of each adjustable cam securement mechanism, wherein the threaded grooves of the inner circumference of the adjustable cam securement mechanisms are screwably engaged with the threads of the cam shaft on opposite sides of each cam with the adjustment bolts each having a first tightened orientation for precluding the adjustability of the associated cam and a second loosened orientation for allowing the adjustability of the associated cam.

3. A combustion engine with adjustable cam comprising as set forth in claim 2 and further including at least one oil agitator with a central portion coupled to the cam shaft and a plurality of fins coupled to the central portion for agitating oil within the engine upon rotation of the cam shaft.

4. A combustion engine with lubrication means comprising a cam shaft having a plurality of threads formed in the cam shaft with the threads being serpentinely configured along the cam shaft, the lubrication means further including a central portion having a cylindrical configuration, the central portion having a threaded bore axially formed therein with a pair of fins integrally coupled to an outer surface thereof and extended radially outward therefrom, each fin having a triangular configuration, the oil agitator further having a threaded aperture formed in the central portion thereof between the outer surface and threaded bore for allowing a set bolt to be screwably inserted therein, the threaded bore of each oil agitator adapted to be threadedly engaged with the threads of the cam shaft for allowing the adjustability thereof, the adjustment bolt of each oil agitator each having a first tightened orientation for precluding the adjustability of the associated oil agitator and a second loosened orientation for allowing the adjustability of the associated oil agitator.

* * * * *